United States Patent [19]

Jacobson et al.

[11] 4,296,191

[45] Oct. 20, 1981

[54] TWO-LAYERED PHOTORECEPTOR CONTAINING A SELENIUM-TELLURIUM LAYER AND AN ARSENIC-SELENIUM OVER LAYER

[75] Inventors: Richard L. Jacobson, Roseville; Timothy T. Lin, Woodbury, both of Minn.

[73] Assignee: Minnesota Mining and Manufacturing Company, St. Paul, Minn.

[21] Appl. No.: 159,878

[22] Filed: Jun. 16, 1980

[51] Int. Cl.[3] ..... G03G 5/082

[52] U.S. Cl. ..... 430/57; 430/85

[58] Field of Search ..... 430/57, 85

[56] References Cited

U.S. PATENT DOCUMENTS

| | | | |
|---|---|---|---|
| 2,745,327 | 5/1956 | Mingali | 430/57 |
| 2,803,541 | 8/1957 | Paris | 430/57 |
| 2,803,542 | 8/1957 | Ullrich | 430/85 |
| 2,822,300 | 2/1958 | Mayer et al. | 430/85 |
| 3,467,548 | 9/1969 | Straugham | 430/57 X |
| 3,655,377 | 4/1972 | Sechak | 430/57 |
| 4,187,104 | 2/1980 | Tutihasi | 430/57 |
| 4,202,937 | 5/1980 | Fukuda et al. | 430/85 X |

*Primary Examiner*—Roland E. Martin, Jr.

*Attorney, Agent, or Firm*—Cruzan Alexander; Donald M. Sell; Robert L. Marben

[57] ABSTRACT

A composite dual layered photoreceptor member useful in the field of electrostatic electrophotography. The photoreceptor has a support member with a bulk layer on the support member of vitreous selenium-tellurium composition and a thin overlayer of vitreous arsenic-selenium composition. The selenium-tellurium can, if desired, be doped with a halogen.

14 Claims, 1 Drawing Figure

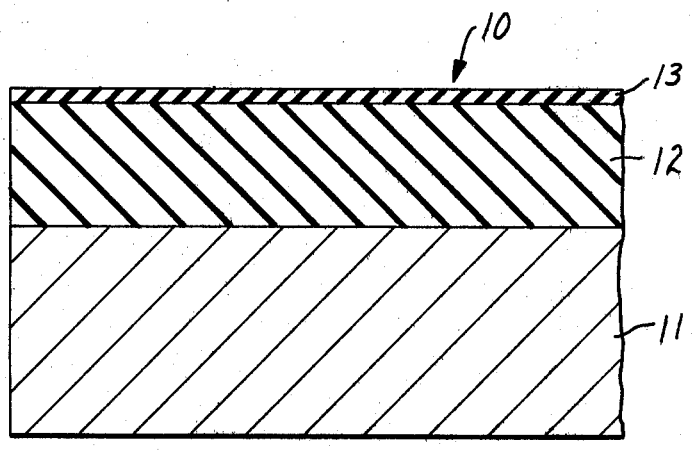
10
13
12
11

TWO-LAYERED PHOTORECEPTOR CONTAINING A SELENIUM-TELLURIUM LAYER AND AN ARSENIC-SELENIUM OVER LAYER

TECHNICAL FIELD

The invention presented herein relates in general to the art of the electrophotography and in particular to a photoreceptor for electrostatic electrophotography. More specifically, the invention relates to a new electrophotographic composite photoreceptor member that is panchromatic responsive and abrasion resistant comprising a first layer of selenium-tellurium with an overlayer of arsenic-selenium.

BACKGROUND ART

Electrostatic electrophotography involves the use of a photosensitive member having a photoconductive insulating layer which is first uniformly electrostatically charged. Electromagnetic radiation, such as light, X-rays or the like, dissipates the charge in areas of the photoconductive insulator to which it is directed causing a latent electrostatic image in the areas where such radiation is not directed. The latent electrostatic image that is produced can be made visible by various development processes such as those in many patents issued to the Xerox Corporation in the field of xerography and those described in U.S. Pat. No. 3,909,258 to Kotz and U.S. Pat. No. 4,121,931 to Nelson.

Extensive use has been made in commercial electrostatic electrophotography of vitreous selenium as a photoconductor, as desribed by Bixby U.S. Pat. No. 2,970,906, since it is capable of holding and retaining an electrostatic charge for relatively long periods of time when not exposed to light and is relatively sensitive to light as compared to other photoconductors. It also possesses sufficient strength and stability to enable it to be reused thousands of times. The effective life of selenium as a photoreceptor member is limited, however, since vitreous selenium is susceptible to deleterious crystal growth. In addition, the spectral response of vitreous selenium, which is limited to the blue or blue-green range of the visible spectrum, restricts its use for some applications in electrostatic electrophotography.

U.S. Pat. No. 2,803,542 to Ullrich and 2,822,300 to Mayer et al, both teach the common concept of improving the property of vitreous selenium by the addition of elemental arsenic in amounts up to about 50% by weight. The addition of arsenic greatly increases the stability of selenium at elevated temperatures and increases spectral response in the yellow-red band of the electromagnetic spectrum when arsenic concentrations greater than 10% by weight are used. Concentrations of arsenic greater than about 10%, however, cause a vitreous selenium photoreceptor to retain a high residual potential with positive charging, and in addition, cause high light fatigue. Very faint, residual negative images in background areas appear after extended repetitive imaging when there is high light fatigue.

Two-layered receptor structures have been designed to overcome some of the above-noted disadvantages. These structures, for example, contain layers of selenium and selenium-tellurium alloys. U.S. Pat. No. 2,803,541 to Paris illustrates one such patent in which improved photosensitivity is attained by using a top layer of vitreous selenium-tellurium over a layer of selenium. The structure provides limited abrasion resistance for automatic copy machine operation and also exhibits high dark discharge. While protective organic and inorganic overcoatings have been used to provide improved abrasion resistance such overcoatings do not function properly through a wide range of environmental conditions. Such overcoatings are known to be humidity sensitive causing image quality problems.

U.S. Pat. No. 3,655,377 to Sechak provides a tri-layer photoreceptor member which overcomes the disadvantages presented by the above-mentioned two layered and the overcoated types of two layered photoreceptor members. Sechak's tri-layer photoreceptor member utilizes a top layer or overcoating of arsenic-selenium alloy for abrasion resistance, temperature stability and improved dark discharge.

It can be seen that the evolution of a photoreceptor member to provide one that is panchromatic responsive, abrasion resistant as well as thermally and humidity stable and not subject to fatiguing effects has resulted in tri-layered photoreceptor structures. This approach, of course, complicates the process of manufacture in that three layers are involved.

DISCLOSURE OF INVENTION

The invention presented here provides a photoreceptor that has the advantages attained by the prior art tri-layer photoreceptor but with the need for only two layers of photoconductive materials. The two-layer photoreceptor of the present invention comprises a bulk layer of a selenium-tellurium composition and a much thinner top layer or overcoating of an arsenic-selenium composition. While the selenium-tellurium layer provides a spectral response range that extends into the red spectral range, the arsenic-selenium layer extends the red end of the spectral response and in addition serves to provide a photoreceptor which is abrasive resistant and temperature stable. In addition, the selenium-tellurium composition used can be halogen doped serving to improve the residual potential characteristic of the photoreceptor. The dual layer of photoreceptor may be vacuum evaporated onto any standard electrostatic electrophotographic base by conventional vacuum evaporation technique known to the art.

BRIEF DESCRIPTION OF THE DRAWINGS

The advantages of the photoreceptor of this invention will become apparent in consideration of the following disclosure of the invention, especially when taken into conjunction with the accompanying drawing wherein a single FIGURE is used which represents a schematic illustration in section of a photoreceptive member in accordance with the present invention.

DETAILED DESCRIPTION

Referring to the drawing, reference character 10 designates a dual layer electrophotographic photoreceptor according to this invention. This photoreceptor utilizes a conventional electrically conductive support member 11 which can be formed from materials such as aluminum, nickel, brass, steel or the like. The support member may be of any convenient thickness, rigid or flexible, and may be in any desired form such as a sheet, web, plate, cylinder, drum, or the like. It may also comprise of a material such as metallized paper, plastic sheets coated with a thin layer of metal such as aluminum or copper iodide or can be glass coated with a thin layer of chromium or tin oxide.

The layer 12 which is carried by the support member 11 comprises a bulk layer of a vitreous selenium-tellurium composition and may be of any convenient thickness keeping in mind that the change acceptance will be low if the layer is too thin. The thickness selected is also dependent on the level of charge to be placed on the photoreceptor when used and the manner in which the charging is to be obtained. For most commercial applications the thickness of the layer 12 will generally lie between about 40 to 80 microns, 60 to 70 microns preferred, with the percentages by weight of tellurium being in the range of about 4 to 10% and about 6% preferred.

The layer 13 is a thin layer of a vitreous arsenic-selenium composition having a thickness in the range of about 0.5 to 5 microns with about 1 micron preferred. The arsenic concentration can be on the order of 5 to 40% by weight. Utilizing a weight level of about 40% arsenic, it is convenient to use arsenic tri-selenide ($As_2Se_3$) since this can be obtained in commercial form and also provides greater spectral responsive in the red portion of the spectrum than is the case for lower percentage of arsenic.

In another embodiment of this invention the bulk layer of selenium-tellurium, may optionally contain a halogen in order to suppress residual potentials. Amounts from about 10 to 80 parts per million by weight is suitable dependent on the halogen used.

The dual layer photoreceptor of this invention may be prepared by any suitable technique. A typical technique includes vacuum evaporation wherein each photoconductive layer is sequentially evaporated onto its corresponding base material. In this technique, the selenium-tellurium composition and arsenic-selenium composition layers are each evaporated by separate steps, under vacuum conditions of about $10^{-5}$ torr. It is also possible to form the two photoreceptive layers by a continuous vacuum method wherein the layers are vacuum evaporated, one after the other, in the same vacuum chamber without breaking the vacuum, by sequentially activating two separate sources of selenium-tellurium and arsenic-selenium. Further details with respect to a suitable vacuum technique for forming the dual layer photoreceptor in accordance with this invention is set forth in the following example:

An aluminum support member in the form of a cylindrical drum is cleaned by a commercial vapor degreaser and then placed in an oven where it is heated to 70° C. A crucible, which can be of stainless steel, is loaded with a mixture of 94% (weight) selenium and 6% (weight) tellurium which has been previously prepared by heating and mixing at an elevated temperature. In this example the mixture is also doped with a halogen, such as chlorine, to a level of about 10 to 30 parts per million. The quantity of such mixture is that which is needed to provide the drum with the desired coating thickness when all of the selenium and tellurium is evaporated from the crucible. For this example, a coating of 65 microns was desired. A crucible load of the desired arsenic-selenium composition which in this example is in the form of arsenic tri-selenide ($As_2Se_3$) is measured. The quantity of $As_2Se_3$ is selected to provide the drum with the desired coating, which in this example is one mircron, when all of the $As_2Se_3$ is evaporated from the crucible. The drum is removed from the oven after it is heated and placed in a vacuum chamber where it is arranged to be rotated during the evaporation coating process to provide uniform coating. The crucible containing the mixture of selenium and tellurium is placed in the chamber and positioned below the drum. The chamber is then evacuated to a vacuum of about $10^{-5}$ torr and electrical power supplied to initiate heating of the crucible of selenium and tellurium to a temperature sufficient to cause it to vaporize at a reasonable rate. By the time the chamber has reached the desired vacuum, the drum will remain at a temperature of about 50°–60° C. With the vacuum present the drop in temperature of the drum is not large. Application of electrical power for evaporation of the mixture of selenium and tellurium is continued until all of the mixture is evaporated which is accomplished in about 30 minutes. Depletion of the mixture of selenium and tellurium is detected by monitoring the temperature of the crucible which rises sharply when all of the selenium and tellurium is evaporated. The electrical power for evaporation of the selenium and tellurium is terminated and a cooled down period of 2–5 minutes is provided after which the chamber is vented to atmosphere. The crucible for the selenium and tellurium is removed and the crucible with the measured amount of $As_2Se_3$ positioned in the chamber below the drum. The procedure outlined above beginning with the evacuation of the chamber is followed for evaporation of the $As_2Se_3$ to provide a one micron overlayer on the selenium-tellurium layer. A higher electrical power input is applied for evaporation of the $As_2Se_3$ since its vapor pressure is different from that of the selenium-tellurium mixture. After the chamber is again vented to atmosphere, the drum is removed from the chamber.

A drum prepared in accordance with the foregoing example providing a layer of about 65 microns of selenium-tellurium with an overlayer of one micron of $As_2Se_3$ was found to have good charge retention characteristics when charged to the level of about 850 volts with low residual potential when utilizing the process over 30 cycles. The residual potential was found to be less than 40 volts. The sensitivity of the dual layered photoreceptor was found to be greater than that of a single layer of selenium-tellurium photoreceptor member by factor of at least 5.

It also noted that increasing the thickness ratio of the $As_2Se_3$ layer to the selenium-tellurium layer provides a photoreceptor that is more light sensitive in the red spectral region, but exhibits an increase in dark decay, fatigue and residual potentials.

In addition to being useful in electrostatic electrophotographic processes wherein a broad spectrum light source is used for establishing a latent image after the photoreceptor has been charged uniformly, the photoreceptor of this invention is also useful in processes or apparatus using a helium-neon laser for an imaging light source which produces electromagnetic radiation of 6328 Angstroms (633 nanometers).

What is claimed is:

1. A composite photoreceptor member including a support layer and only two layers of photoconductive materials, said two layers including:

a. a first layer of a vitreous selenium and tellurium composition carried on the support layer, b. and a second layer comprising vitreous arsenic-selenium composition overlaying said layer of vitreous selenium-tellurium composition wherein said layer of selenium-tellurium composition is about 40 to 80 microns in thickness and said layer of arsenic-selenium composition is about 0.5 to 5.0 microns in thickness.

2. The photoreceptor member according to claim 1 wherein said layer of vitreous selenium-tellurium composition is doped with a halogen.

3. The photoreceptor member according to claim 1 wherein said layer of vitreous selenium-tellurium composition contains tellurium in the range of 4 to 10 percent by weight.

4. The photoreceptor member according to claim 3 wherein said layer of vitreous selenium-tellurium is doped with a halogen.

5. The photoreceptor member according to claim 1 wherein said layer of vitreous arsenic-selenium composition contains arsenic in the range of 5 to 40 percent by weight.

6. The photoreceptor member according to claim 5 wherein said layer of vitreous selenium-tellurium is doped with a halogen.

7. The photoreceptor member according to claim 1 wherein said layer of vitreous arsenic-selenium composition is arsenic tri-selenide.

8. The photoreceptor member according to claim 7 wherein said layer of vitreous selenium-tellurium is doped with a halogen.

9. The photoreceptor member according to claim 1 wherein said layer of vitreous selenium-tellurium composition contains tellurium in the range of 4 to 10 percent by weight and said layer of arsenic-selenium composition contains arsenic in the range of 5 to 40 percent by weight.

10. The photoreceptor member according to claim 9 wherein said layer of vitreous selenium-tellurium is doped with a halogen.

11. The photoreceptor member according to claim 1 wherein said layer of vitreous selenium-tellurium composition contains tellurium in the range of 4 to 10 percent by weight and said layer of arsenic-selenium composition is arsenic tri-selenide.

12. The photoreceptor member according to claim 11 wherein said layer of vitreous selenium-tellurium is doped with a halogen.

13. The photoreceptor member according to claim 1 wherein said layer of vitreous selenium-tellurium composition contains about 6 percent tellurium by weight and said layer of arsenic-selenium composition is arsenic-tri-selenide.

14. The photoreceptor member according to claim 13 wherein said layer of vitreous selenium-tellurium is doped with a halogen.

* * * * *